US005492172A

United States Patent [19]

Laveran et al.

[11] Patent Number: 5,492,172

[45] Date of Patent: Feb. 20, 1996

[54] REINFORCED HEADER PLATE FOR A HEAT EXCHANGER

[75] Inventors: Jean-Louis Laveran, Asnieres; Daniel Hervel, Paris; Dany Boquel, Ablis, all of France

[73] Assignee: Valeo Thermique Moteur, Les Mesnil-Saint Denis, France

[21] Appl. No.: 447,619

[22] Filed: May 23, 1995

[30] Foreign Application Priority Data

May 26, 1994 [FR] France ..... 94 06398

[51] Int. Cl.[6] ..... F28F 9/02

[52] U.S. Cl. ..... 165/173; 165/906; 29/890.052

[58] Field of Search ..... 165/173, 906; 72/379.6; 29/890.052

[56] References Cited

U.S. PATENT DOCUMENTS

| | | | |
|---|---|---|---|
| 4,582,127 | 4/1986 | Moranne | 165/83 |
| 4,881,594 | 11/1989 | Beamer et al. | 165/173 |
| 5,107,926 | 4/1992 | Calleson | 165/173 |
| 5,193,613 | 3/1993 | Wallis | 165/173 |
| 5,228,512 | 7/1993 | Bretl et al. | 165/153 |
| 5,297,624 | 3/1994 | Haussmann et al. | 165/173 |

FOREIGN PATENT DOCUMENTS

| | | |
|---|---|---|
| 2270471 | 5/1975 | France . |
| 2681421 | 4/1992 | France . |

*Primary Examiner*—Allen J. Flanigan
*Attorney, Agent, or Firm*—Morgan & Finnegan

[57] ABSTRACT

A header plate, which forms one wall of the internal space of a fluid header for a cooling radiator for air used in supercharging a motor vehicle engine, has apertures through which the fluid flow tubes of the heat exchanger extend. These apertures are formed in an elongated flat region of the header plate, which is joined to raised side flanges through respective curved regions. The material of the header plate is press-formed, on the same side as the concavity of these curved regions, in zones which are aligned in the transverse direction of the header plate and which extend over at least the whole length of arc of each of the curved regions. The deformation resulting from this press-forming operation causes local thickening of the material, which reinforces the plate in its curved regions and inhibits any tendency to fracture along the generatrices of the curved regions due to mechanical and thermal stresses encountered in operation.

10 Claims, 1 Drawing Sheet

REINFORCED HEADER PLATE FOR A HEAT EXCHANGER

FIELD OF THE INVENTION

This invention relates to a header plate defining a wall of the internal space of a fluid header of a heat exchanger, especially a cooling radiator for a motor vehicle, wherein the header plate has apertures for accommodating fluid flow tubes, the said apertures being formed in a substantially flat region of the header plate, the said flat region being joined to at least one curved region having the general form of part of a cylinder and being spaced away from the plane of the said flat region on the same side as the said internal space.

BACKGROUND OF THE INVENTION

Such header plates are used in particular in radiators which are employed for the cooling of supercharging air in motor vehicles, in which the supercharging air, which flows in the header and in the tubes, is at a high pressure and at a temperature which may exceed 100° C. This gives rise to mechanical and thermal stresses in the header plate which, especially when the latter is made of aluminium alloy, can give rise to the formation of cracks along the generatrix of the curved region, the latter having already undergone fatigue during the bending operation in which it was initially formed.

DISCUSSION OF THE INVENTION

An object of the present invention is to overcome this drawback, and to provide a header plate which is able to resist, without failure, severe mechanical and thermal stresses.

According to the invention in a first aspect, a header plate defining a wall of the internal space of a fluid header of a heat exchanger, especially a cooling radiator for a motor vehicle, wherein the header plate has apertures for accommodating fluid flow tubes, the said apertures being formed in a substantially flat region of the header plate, the said flat region being joined to at least one curved region having the general form of part of a cylinder and being spaced away from the plane of the said flat region on the same side as the said internal space, is characterised in that each said part-cylinder is interrupted, without any discontinuity in the material, by a respective one of a plurality of raised zones spaced apart along the generatrix of the cylinder, with each said raised zone extending over the whole length of the arc defined by the said part-cylinder, the inner and outer faces of the header plate in the said raised zones being locally offset inwardly, and its thickness being locally increased with respect to the faces and thickness, respectively, of the said part-cylinder.

The increase in thickness which has been found to occur in these raised zones, in a header plate according to the invention, can be explained by the need to compensate, at a constant volume, for the reduction in the size of the latter along the arc defined by the part-cylinder, i.e. in the circumferential direction of the curved region, due to the displacement of material towards its centre of curvature. It is thought that this local increase in thickness prevents stresses or deformations that could lead to fracture from being propagated along the generatrix.

According to a preferred feature of the invention, each said raised zone has, in a plane parallel to the generatrix and extending across the thickness of the header plate, a profile in the form of a rounded bead and/or a form having flared sides.

According to another preferred feature of the invention, the or each said curved region is joined at the two ends of its length of arc, respectively to the said flat region and to a marginal region of the header plate extending substantially in a plane at right angles to that of the flat region.

According to a further preferred feature of the invention, the faces of the or each said curved region are substantially tangential to those of the flat region, and also, if necessary, to those of the adjacent marginal region.

According to yet another feature of the invention, the flat region is of elongate form and is joined through its two sides, substantially parallel to each other, to two respective said curved regions having the said raised zones.

According to a still further feature of the invention, the said raised zones are continuous from one of the two curved regions to the other so as to interrupt the flat form of the said flat region, with each of the said apertures being situated between two successive raised zones.

The header plate according to the invention is preferably made of an aluminium alloy.

According to the invention in a second aspect, a method of making a header plate according to the invention, starting with a substantially flat blank having a substantially uniform thickness, comprises the steps of: press-forming the material of the blank at right angles to the plane of the latter, in zones which are spaced apart from each other and aligned in the said plane; bending at least one region of the blank so as to give it the general form of part of a cylinder, by deflecting it away from the initial plane of the blank in the same direction in which the material was displaced in the previous step, the generatrix of the said cylinder being parallel to the direction of alignment of the said zones, with these latter extending over the whole length of arc of the part-cylinder; and forming the said apertures before, during or after the foregoing operations, in the flat region of the plate that survives as a flat region from the initial blank.

According to the invention in a third aspect, in a heat exchanger, especially a cooling radiator for a motor vehicle, including a fluid header having an internal space bounded by a header plate, the said internal space being in communication with fluid flow tubes extending through apertures formed in a substantially flat region of the header plate, with the said flat region being joined to at least one curved region having the general form of part of a cylinder extending from the plane of the said flat region on the same side as the said internal space, the header plate is a header plate according to the present invention as defined above.

The various features and advantages of the invention will appear more clearly and in greater detail from a reading of the description which follows, of a preferred embodiment of the invention. This description is given by way of example only and with reference to the accompanying drawings.

DESCRIPTION OF A PREFERRED EMBODIMENT OF THE INVENTION

Figure 1:
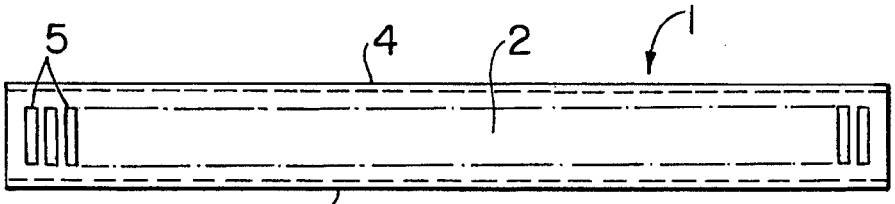
FIG. 1 is a top plan view of a known type of header plate.
Figure 2:
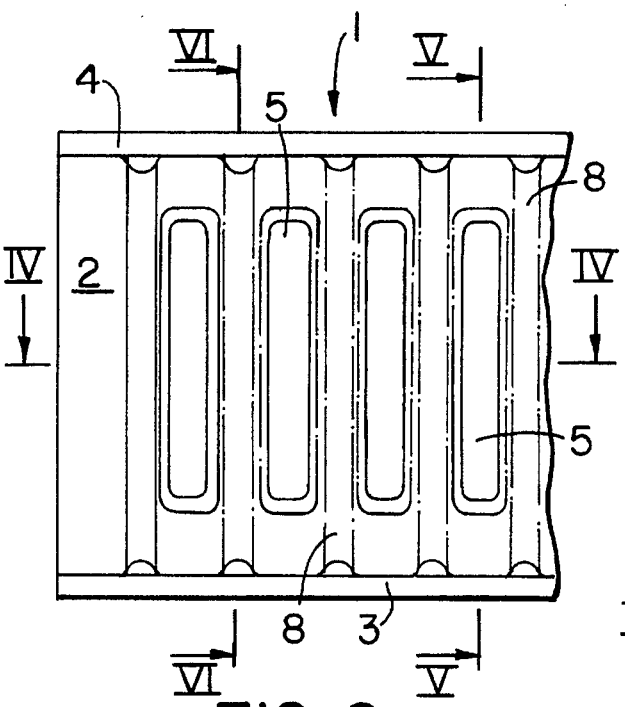
FIG. 2 is a top plan view on a larger scale, showing part of a header plate in accordance with the present invention.

Reference is first made to FIG. 1, which shows a known type of header plate 1 intended to form part of a radiator for the cooling of air for supercharging the engine of a motor vehicle. This header has the same general form as the header plate in accordance with the invention which will be described in detail below with reference to FIGS. 2 to 6.

The header plate is made from aluminium alloy sheet, in the form of an elongated rectangular blank, and includes a flat region 2, in the form of a relatively narrow rectangle having two longitudinal sides. Each of these sides is joined, through a region curved through a quarter of a circle, to a respective one of two raised flanges 3 and 4, each of which lies above the plane of the drawing in FIG. 1. The flat middle region 2 is formed with through apertures 5, which are aligned in the longitudinal direction of the plate and which are arranged to receive the heat exchanger tubes (not shown) through which the air to be cooled flows. Each of the apertures 5 has the general shape of a rectangle which is elongated at right angles to the longitudinal direction of the plate.

Referring now to FIGS. 2 to 6, the header plate 1 according to the invention, shown in these Figures, again has the flat central region 2, the raised flanges 3 and 4 and the apertures 5. The flanges 3 and 4, which extend in planes at right angles to that of the central region 2, are joined to the latter through respective regions 6 and 7, each of which is curved through a quarter of a circle, so as to form a quarter of a cylinder having a generatrix extending along the length of the region 2. In a known manner, this general part-cylinder form is obtained by press-forming so as to deform an initially flat blank in such a way that the regions lying on either side of the central region 2 are displaced away from the plane of the blank so as to form the quarter-cylindrical curved regions 6 and 7 and the flat marginal regions or flanges 3 and 4.

Prior to the operation of bending the regions 6 and 7, the material of the blank is displaced, by a pressing operation, in a plurality of zones 8 which are spaced apart in the longitudinal direction of the plate. This displacement takes place in the same direction as the displacement of the material in the previous step in which the curved regions 6 and 7 were formed, that is to say towards the right in FIGS. 5 and 6. The result of this initial pressing operation, prior to formation of the curved regions, is shown in the upper half of FIG. 6. Here it can be seen that each zone 8 is a raised zone consisting of a raised rib 10, backed by a groove 9. These extend at right angles to the longitudinal direction of the plate and which lie in opposition to each other in the inner and outer faces of the plate, i.e. the faces directed towards the left and right respectively in FIG. 6. The rib 10 and groove 9 extend in this example over the whole width of the central region 2, and also over the region indicated at 7' in FIG. 6, from which the curved region 7 is formed during the subsequent bending operation.

Figure 6:
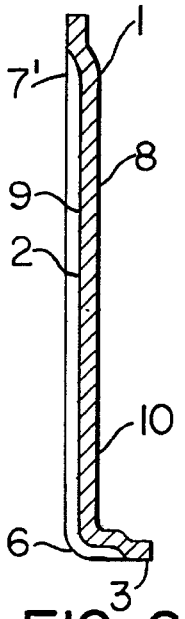
FIG. 6 is a view in cross section taken on the line VI—VI in FIG. 2, and shows the header plate in an intermediate stage of its manufacture.

The groove 9 and rib 10 also extend, symmetrically with respect to the longitudinal mid plane of the plate, over the whole width of the region from which the curved region 6 is formed, this latter being shown in FIG. 6 as having already been formed. In the finished header plate, they extend without interruption from the marginal flange 3 to the marginal flange 4, terminating at a point short of the free edges of these latter. The extension of the raised zones 8, from one curved region to the other over the whole width of the flat central region 2, enables the header plate to absorb severe thermal stresses without any permanent deformation, as is described in the French published patent application FR 2 538 526A. In a heat exchanger in which this added strengthening is not necessary, the raised zones 8 may be confined to the curved regions 6 and 7.

Figure 5:
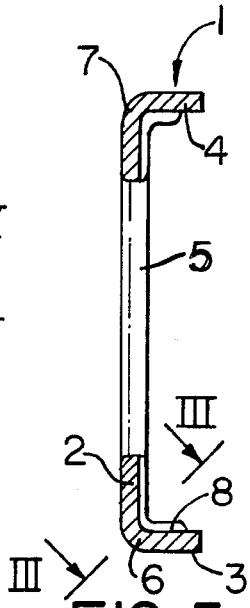
FIG. 5 is a view in cross section taken on the line V—V in FIG. 2.
Figure 7:
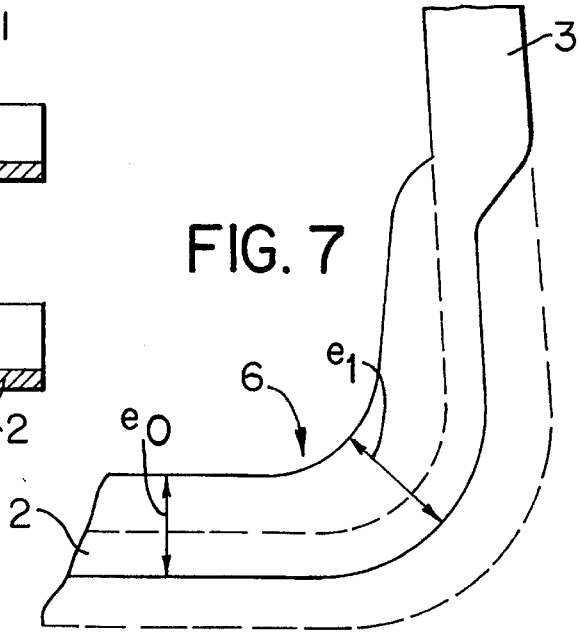
FIG. 7 is a diagram showing profiles of the header plate seen in FIGS. 2 to 6.

FIG. 7 shows the profile of the header plate as viewed in the plane of FIG. 5, in the curved region 6 and in the vicinity of the latter. The profile of the header plate of FIGS. 2 to 6 is shown in FIG. 7 in full lines, while that of the prior art header plate of FIG. 1 is shown in broken lines. In the case of the prior art header plate, the final wall thickness is substantially uniform, and is equal to the thickness of the initial flat blank, being for example 2.90 mm. As to the header plate of FIG. 2, the thickness $e_0$, halfway through the width of the deformed zone 8 in the flat central region 2, again remains substantially equal to the initial thickness of the blank. However, in the curved region 6, this thickness is increased, and passes through a maximum value $e_1$, occurring substantially halfway along the arc, for which values of 3.20 to 3.50 mm have been measured.

Figure 3:
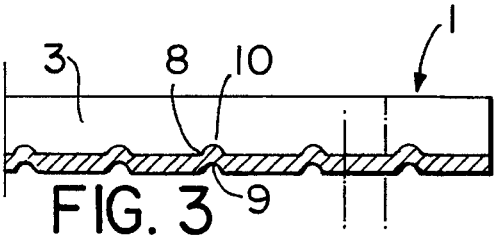
FIG. 3 is a partial view in cross section taken on the line III—III in FIG. 5.
Figure 4:
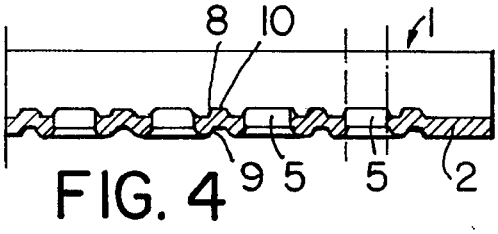
FIG. 4 is a partial view in cross section taken on the line IV—IV in FIG. 2.

The profile of the grooves 9 and ribs 10, as viewed in a plane at right angles to their longitudinal direction, is determined by the tools which are employed to carry out the pressing operation on the material in order to form the raised zones 8. This profile is preferably in the form of a rounded bead with extended flap portions, as can be seen in FIGS. 3 and 4, so as to minimise mechanical stresses. It can also be seen that each raised zone 8 is short in length, in the longitudinal direction of the header plate, as compared with the length of the zones lying between two adjacent zones 8. These intermediate zones retain a flat or cylindrical form, except in those portions which are deformed by punching out the apertures 5. One aperture 5 is formed in each of these intermediate zones.

What is claimed is:

1. A header plate adapted to define a wall of the internal space of a heat exchanger fluid header, the header plate comprising a substantially flat region defining apertures for accommodating fluid flow tubes of said heat exchanger, and a curved region joined to said flat region and having the general form of part of a cylinder, the plate having a first side for facing into said internal space, and a second side, the said curved region extending away from the plane of the flat region on said first side of the plate, wherein the plate further defines a plurality of raised zones interrupting the said part-cylinder in the curved region with continuity of material, the said raised zones being spaced apart along the generatrix of the said cylinder, with each raised zone extending over the whole length of arc defined by said part-cylinder in the curved region, the inner and outer faces of the header plate in the curved region being locally offset inwardly, and its thickness being locally increased in the said raised zones, as compared with the said faces and thickness of the said part-cylinder.

2. A header plate according to claim 1, wherein each said raised zone has, in a plane parallel to the generatrix and passing through the thickness of the header plate, a profile defining at least one of a rounded bead and flared sides.

3. A header plate according to claim 1, further including a marginal region extending substantially in a plane at right angles to that of the said flat region, the said curved region joining the marginal region to the flat region at the two respective ends of the said length of arc in the curved region.

4. A header plate according to claim 1, wherein the faces of the curved region are substantially tangential to those of the flat region.

5. A header plate according to claim 1, wherein the said flat region is of elongate form, the header plate having two said curved regions, each with said raised zones, the flat region having two substantially parallel sides and being joined along each of said sides to a respective one of the curved regions.

6. A header plate according to claim 5, wherein the said raised zones extend continuously across the plate from one said curved region to the other so as to interrupt the flat form of the said flat region, the said apertures being formed between successive said raised zones.

7. A header plate according to claim 1, made of aluminium alloy.

8. A method of making a header plate according to claim 1, comprising the steps of: taking a substantially flat blank of substantially uniform thickness; press-forming the material of the blank at right angles to its plane in zones spaced apart from each other and aligned in the said plane, so as to form raised zones; bending a generally longitudinally extending region of the blank so as to give the said region the general form of part of a cylinder, displaced from the plane of the blank in the same direction as that in which the material was displaced in forming the said raised zones, and so that the generatrix of the said cylinder is parallel to the direction in which the said zones are aligned, with the latter extending over the whole length of arc of the part-cylinder; and, at any stage after the blank has initially been taken, forming the said apertures in respective flat portions thereof between the sites of the said raised zones.

9. A heat exchanger having a fluid header defining an internal space thereof, the header including a header plate according to claim 1 defining a wall of the said space, and a plurality of fluid flow tubes extending through the apertures in the header plate.

10. A heat exchanger according to claim 9, being a supercharging air cooler for a motor vehicle heat engine.

* * * * *